US006731073B2

(12) United States Patent
Van Veldhuizen

(10) Patent No.: US 6,731,073 B2
(45) Date of Patent: May 4, 2004

(54) SAFETY STARTER FOR FLUORESCENT LAMPS

(75) Inventor: Robert Henk Van Veldhuizen, Terneuzen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/277,569

(22) Filed: Oct. 22, 2002

(65) Prior Publication Data

US 2003/0085668 A1 May 8, 2003

(30) Foreign Application Priority Data

Oct. 25, 2001 (EP) ..... 01204079

(51) Int. Cl.[7] ..... H05B 41/14

(52) U.S. Cl. ..... 315/94; 315/98; 315/360; 315/362; 315/DIG. 2; 315/DIG. 4; 315/DIG. 5

(58) Field of Search ..... 315/94, 98, 209 T, 315/209 CD, 209 M, 360, 362, DIG. 2, DIG. 4, DIG. 5

(56) References Cited

U.S. PATENT DOCUMENTS 4,603,281 A * 7/1986 Nilssen ..... 315/106
4,746,841 A * 5/1988 Ogawa ..... 315/102
4,791,338 A * 12/1988 Dean et al. ..... 315/174
4,920,299 A * 4/1990 Presz et al. ..... 315/98
5,049,783 A * 9/1991 Kroening ..... 315/102
5,616,992 A 4/1997 Bildgen ..... 315/209 T

FOREIGN PATENT DOCUMENTS

| | | | |
|---|---|---|---|
| DE | 2725532 A1 | 12/1978 | ..... H05B/41/232 |
| DE | 19734298 A | 12/1998 | ..... H05B/41/232 |
| EP | 0333359 A1 | 9/1989 | ..... H05B/41/04 |
| EP | 0520735 A1 | 12/1992 | ..... H05B/41/04 |
| EP | 1089598 A2 | 4/2001 | ..... H05B/41/04 |

* cited by examiner

*Primary Examiner*—Don Wong
*Assistant Examiner*—Thuy Vinh Tran
(74) *Attorney, Agent, or Firm*—Ernestine C. Bartlett

(57) ABSTRACT

A fluorescent lamp starter circuit that incorporates the series arrangement of a glow-switch and a semiconductor switch. The semiconductor switch is coupled to a solid state timer. The solid state timer renders the semiconductor switch non-conductive after it has timed a predetermined maximum operation interval. The duration of lamp ignition attempts is thereby limited.

6 Claims, 1 Drawing Sheet

SAFETY STARTER FOR FLUORESCENT LAMPS

FIELD OF THE INVENTION

The present invention relates generally to safety starters, and more particularly to a fluorescent lamp starter protection circuit.

BACKGROUND OF THE INVENTION

A fluorescent lamp starter circuit is essentially a time delay switch that allows a preheating circuit to warm the filaments at each end of a fluorescent lamp before the lamp is ignited. The most common automatic starter is a "glow tube starter" circuit that typically includes a glow-switch that is normally open. When current is applied to the glow tube starter circuit, the resulting glow discharge heats a bimetal contact which causes the contacts of the glow-switch to close a short time (1–2 seconds) thereby providing current to a preheating circuit and extinguishing the glow discharge. While the filaments are warming, the bimetal ultimately cools such that the contacts open thereby interrupting the current through the preheating circuit and producing an inductive "kick" through the ballast that should cause the lamp to ignite. However, the magnitude of the inductive kick is dependent upon the current supplied to the glow tube starter circuit and may at times be insufficient to ignite the lamp, thus requiring several successive attempts. Furthermore, the glow tube starter can cycle indefinitely if the lamp driven by the ballast is defective.

It is known to incorporate a pulse starter circuit in an attempt to improve the reliability of the glow tube starter circuit. A pulse starter circuit is designed to reduce the number of failed ignition attempts by electronically detecting the appropriate time to disengage the preheating circuit so as to optimize the inductive kick produced by the ballast. To increase the safety of the glow tube starter circuit, it is known to incorporate a thermal switch to disengage the glow tube starter circuit if an excessive number of ignition attempts is made, thereby eliminating the persistent blinking that occurs when a lamp cannot be started. Once disengaged, such existing "safety starter" circuits must be reset by means of a manual reset button in the luminaire, which is typically mounted on the ceiling. If a lamp has actually failed, this reset procedure can be accomplished while replacing the lamp. However, the occasional non-defective lamp is difficult to start simply because it is cold, so replacing the lamp is unnecessary. In such a situation, gaining access to the ceiling-mounted luminaire for the sole purpose of performing the manual reset procedure is extremely inconvenient and therefore disadvantageous.

Despite the improvements afforded by the pulse starter circuit and the safety starter circuit, existing glow tube starter configurations have additional disadvantages. The operation time (i.e., the elapsed time between the first and last attempt to ignite the lamp) is dependent upon the current level in the preheating circuit. Therefore, existing safety starters can only be implemented in lamp circuits that can maintain current levels that are high enough to produce temperatures that will trigger the thermal switch after the maximum allowable number of attempts to start the lamp has been made. Furthermore, the safety starter circuit is commonly configured such that the thermal switch is exposed to ambient environmental conditions (e.g., temperature and humidity), which at times results in sticking contacts that can cause dangerous failures due to overheating.

In spite of the recognized need, a continuing failure in the art has been an inability to provide an automatic starter that is reliable, safe, versatile, and easy to operate.

SUMMARY OF THE INVENTION

The circuit of the present invention fulfills the needs described above by implementing an automatic starter that includes a safety starter circuit, comprising a timer switch and a timer such as an electronic timer coupled to the timer switch and prevents the glow-switch from continually striking a lamp that has failed. The safety starter circuit can be configured to automatically reset whenever glow-switch cycling has ended either because the lamp has ignited, or because the safety starter circuit has ended the glow-switch cycling. Alternatively the timer can be reset when the supply voltage is switched on or off. The performance of the safety starter circuit is not affected by the ambient environment or the preheat current.

An exemplary embodiment of the present invention is a safety starter that controls the ignition of a fluorescent lamp. During operation a supply voltage provides power to a series arrangement comprising a ballast, lamp filaments and the safety starter. The safety starter comprises a series arrangement of a glow-switch and the timer switch. A control electrode of the timer switch is coupled to a timer such as a solid state timer. When both the glow-switch and the timer switch are conductive a preheat current flows through the filaments of the fluorescent lamp so that the lamp electrodes are preheated before a striking voltage is generated to ignite the lamp. The glow-switch allows current to flow through the lamp filaments long enough for the electrodes to be sufficiently heated. The contacts of the glow-switch subsequently open, thereby inducing a striking pulse intended to ignite the lamp. If the lamp is not ignited, the glow-switch cycles again. The timer and the timer switch limit the duration of the cycling of the glow-switch so that cycling does not occur beyond a predetermined maximum operation interval, such as the IEC maximum of five minutes. The solid state timer increments only while current flows through the glow-switch, a sensing resistor (that may be integral to the solid state timer) detecting the current flowing through the glow-switch. A capacitor that suppresses radio frequency (RF) interference is integrated in the safety starter. In this exemplary embodiment, the capacitor is connected in parallel with the glow switch.

In an alternative embodiment, the capacitor is connected in parallel with the fluorescent lamp. In this alternative embodiment the timer increments continuously, and the capacitor is not protected by the timer switch.

Additional objects, advantages and novel features of the invention will be set forth in part in the description which follows, and in part will become more apparent to those skilled in the art upon examination of the following, or may be learned by practice of the invention.

BRIEF DESCRIPTION OF THE DRAWINGS

The accompanying drawings, which are incorporated in and form part of the specification, illustrate the present invention when viewed with reference to the description, wherein.

DETAILED DESCRIPTION OF THE EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
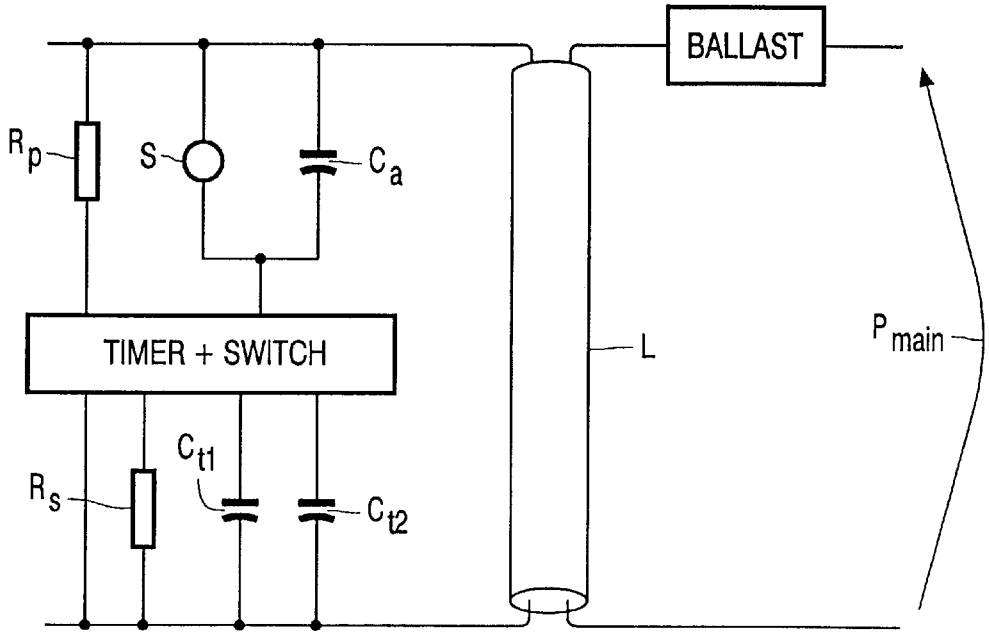
FIG. 1 is a circuit diagram of an exemplary safety starter circuit according to an embodiment of the present invention with a lamp and a ballast connected to it.

FIG. 1 is a circuit diagram of an exemplary safety starter circuit according to an embodiment of the present invention. Referring to FIG. 1, the safety starter circuit includes a timer with an integrated timer switch, a switch S, a capacitor Ca, and a sense resistor Rs. The timer is a solid state device that has no mechanical contacts that are exposed to the environment. The switch S is a glow switch that has the advantage of being relatively inexpensive and compact. In this example, additional capacitors $C_{t1}$ and $C_{t2}$ act as voltage buffers and assist in timing, although alternative means can be implemented.

Referring again to FIG. 1, in the first embodiment of the present invention, the capacitor Ca is connected in parallel with the switch S. The capacitor Ca serves to remove radio frequency interference. The switch S and the capacitor Ca are connected from the timer to the electrode at the first end of the lamp L. The timer is connected from the electrode at the second end of the lamp L to the switch S and the capacitor Ca. Capacitors $C_{t1}$ and $C_{t2}$ are connected in parallel with a sensing resistor Rs from the timer to the electrode at the second end of the lamp L. The electrode at the first end of the lamp L is also connected to a ballast for limiting the current through the lamp L. The power supply $P_{main}$ is connected across the ballast and lamp L. A power resistor Rp is connected to the timer and the switch S.

When the power supply is turned on, the preheating circuit is activated through the switch S. In this exemplary embodiment, the switch S is a glow-switch that contains two contacts, one of which is formed by a bimetallic strip, sealed in a small glass bulb containing an inert gas mixture. The bulb is mounted in a small cylindrical container of aluminum or polycarbonate. A glow discharge between the contacts of the glow switch makes the bimetallic strip heat up and bend until both contacts of the glow switch make contact. While the contacts are in contact with each other the glow switch is conductive and a preheat current flows through the lamp electrodes. While the preheat current flows the contacts of the glow switch cool down and subsequently open, thereby inducing a striking pulse sufficient to ignite the lamp. However, if the ignition attempt fails, the glow-switch continues to cycle through ignition attempts as long as permitted by the protection circuit. The protection circuit includes the timer, the timer switch, and the sensing resistor Rs. The timer increments while current flows through the glow-switch S (and the sensing resistor Rs) and until a maximum interval has elapsed.

When the lamp ignites, both the lamp and the lamp ballast carry a current. As a result the voltage across the lamp decreases and therefore also the voltage over the glow switch decreases. Because of this decrease in the voltage over the glow switch no glow discharge develops between the contacts so that the glow switch remains non-conductive. When the lamp ignites before the maximum time interval has elapsed, the timer does not increment further so that the timer switch remains conductive. Therefore the capacitor Ca is part of a conducting series arrangement (consisting of the capacitor Ca, the timer switch and resistor Rs) in parallel with the lamp and suppresses RFI during stationary operation. The timer resets automatically when a user switches the supply voltage off or when the supply voltage is switched on. In case the lamp has not ignited when the timer has timed the maximum time interval, the timer switch is rendered non-conductive so that there are no further attempts to ignite the lamp.

Figure 2:
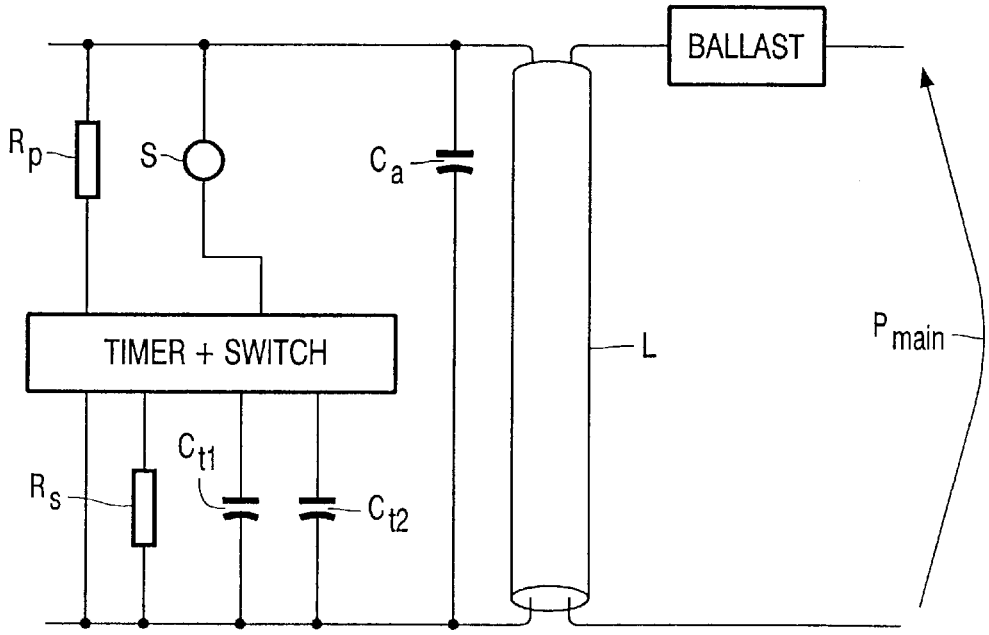
FIG. 2 is a circuit diagram of an alternative exemplary safety starter circuit according to an embodiment of the present invention with a lamp and a ballast connected to it.

FIG. 2 is a circuit diagram of an alternative exemplary safety starter circuit according to an embodiment of the present invention. In this alternative embodiment, the capacitor Ca is connected in parallel with the lamp L and suppresses RFI irrespective of the conductive state of the timer switch. In this configuration the timer increments during a predetermined maximum operation interval and renders the timer switch non-conducting at the end of the predetermined time interval. The predetermined maximum operation interval is chosen such that it encompasses a number of glow switch cycles that is high enough for a lamp that is not defective to ignite. In case of a defective lamp the glow-switch S can continue cycling during the predetermined maximum operation interval. When the lamp ignites before the timer has timed the predetermined maximum operation interval the glow switch stops cycling because of the decrease in the voltage across the lamp. In case the lamp does not ignite, the cycling of the glow switch is stopped and no further attempts are made to ignite the lamp because the timer renders the timer switch non-conductive. Also in this embodiment the timer resets when the supply voltage is switched off or alternatively when the supply voltage is switched on.

In view of the foregoing, it will be appreciated that the present invention provides a system for accurate, efficient, and cost-effective electrode heating and lamp ignition that limits the number of ignition attempts. Still, it should be understood that the foregoing relates only to the exemplary embodiments of the present invention, and that numerous changes may be made thereto without departing from the spirit and scope of the invention as defined by the following claims.

What is claimed is:

1. A safety starter circuit adapted to control the ignition of a lamp having a lamp electrode at each end, said safety starter circuit comprising:

a control means configured to control a preheat current flowing through the lamp electrodes, the preheat current for causing a preheating of the lamp electrodes; and a protection circuit coupled in series with said control means, wherein the series coupled control means and protection circuit couple in parallel with the lamp across the lamp electrodes, said protection circuit configured to limit a duration of the activation of said control means below a predetermined maximum operation interval, said protection circuit comprising:

a switch connected in series with the control means and configured to enable an activation of the control means in response to the switch being conductive; and a timer for timing the predetermined maximum operation interval and having an output coupled to a control electrode of the switch to render the switch non-conductive at the end of the predetermined maximum operation interval.

2. The safety starter circuit of claim 1, wherein the control means is a glow-switch.

3. The safety starter circuit of claim 1, wherein said safety starter circuit further comprises a capacitor connected in parallel with the lamp and wherein the timer is configured to increment continuously during the predetermined maximum operational interval irrespective of an operational state of said control means, wherein the switch is rendered non-conductive at the end of the predetermined maximum operational interval.

4. The safety starter circuit of claim 1, wherein said safety starter circuit further comprises a capacitor connected in parallel with said control means and wherein the timer includes a solid state timer.

5. The safety starter circuit of claim 4, wherein said protection circuit further comprises a sensing resistor for sensing a current flowing through said control means, wherein the sensing resister is integral to the solid state timer, further wherein the solid state timer is operational to increment up to the predetermined maximum operational interval in response to the sensing resistor sensing the current flowing through said control means, wherein the switch is rendered non-conductive at the end of the predetermined maximum operational interval.

6. The safety starter circuit of claim 1, wherein the timer is an electronic timer.

* * * * *